United States Patent [19]

Russell

[11] Patent Number: 5,036,310

[45] Date of Patent: Jul. 30, 1991

[54] REMOTE MAIL DELIVERY REPORTING SYSTEM TRIGGERED BY PREDETERMINED MAIL IN A MAILBOX

[76] Inventor: David E. Russell, 2554 Ernest St., Jacksonville, Fla. 32204

[21] Appl. No.: 637,441

[22] Filed: Jan. 4, 1991

[51] Int. Cl.[5] ..... G08B 21/00

[52] U.S. Cl. ..... 340/569; 340/551; 340/572

[58] Field of Search ..... 340/569, 533, 572, 551

[56] References Cited

U.S. PATENT DOCUMENTS

| | | | |
|---|---|---|---|
| 4,446,454 | 5/1984 | Pyle | 340/533 |
| 4,647,917 | 3/1987 | Anderson, III et al. | 340/551 |
| 4,868,543 | 9/1989 | Binkley | 340/569 |
| 4,940,966 | 7/1990 | Pettigrew et al. | 340/572 |

*Primary Examiner*—Glen R. Swann, III
*Attorney, Agent, or Firm*—Arthur G. Yeager

[57] ABSTRACT

The delivery of special, preselected mail to a mailbox is detected and announced by including a piece of magnetic material or a metal object with the envelope. A magnetic detector or metal detector, within the mailbox, senses the presence of the magnetic material or metal object and actuates a radio transmitter, at the mailbox, which sends a signal to a radio receiver. Upon receiving the radio signal, the radio receiver activates a telephone answering device, or an automated building control or surveillance center having remote interrogation access or capable of sending an announcement so that a person at a distant telephone can be advised of the mail delivery. Electric wiring may be utilized in lieu of radio transmission.

20 Claims, 1 Drawing Sheet

REMOTE MAIL DELIVERY REPORTING SYSTEM TRIGGERED BY PREDETERMINED MAIL IN A MAILBOX

RELATED APPLICATION

This application relates to a now abandoned application Ser. No. 07/258,502, filed Oct. 17, 1988, in which claims were allowed.

BACKGROUND OF THE INVENTION

1. Field of the Invention

The present invention relates to mailboxes and more particularly to a mailbox containing a detector for detecting the presence of a selectively predetermined piece of mail, such as mail having a ferrous metal or the like or magnetic material to actuate a radio transmitter capable of sending a signal to a nearby radio receiver which, in turn, controls the ultimate visual or audio announcement of the arrival of the mail. In lieu of radio transmission, electric wiring may be employed to control the ultimate announcement.

2. Description of the Prior Art

A number of mail detectors are known in the prior art, including those described in the following U.S. Patents:

| U.S. Pat. No. | Granted TO | Date |
|---|---|---|
| 2,968,804 | Buffington | Mar. 19, 1957 |
| 3,611,333 | Conigliaro | Oct. 5, 1971 |
| 4,101,877 | Rush | Jul. 18, 1978 |
| 4,291,342 | O'Connor | Sep. 22, 1981 |
| 4,520,350 | Huang | May 28, 1985 |
| 4,651,135 | Duhaime et al | Mar. 17, 1987 |

Canadian Patent No. 507,682 granted to Bordner on Dec. 6, 1954, also describes a mail detector.

Telephone answerers or answering machines which record messages and which can be accessed from distant telephones, are well known in the present commercial market. Automatic telephone dialers for "Smart" houses with automatic control systems interfacing various appliances and telephone answerers are also well known, and several such systems are described in the following issues of Popular Science Magazine: August 1988, June 1990, September 1990 and October 1990. In addition, Heath of Benton Harbor, Mich., sells a "House Sitter" which includes a dialer for initiating a telephone call up to four different programmable numbers upon certain alarm conditions. Similar systems for "Smart" office buildings are also well known, integrating air conditioning, security, life safety, etc.; these are described in various publications of the American Society of Heating, Refrigerating and Air Conditioning Engineers (ASHRAE). Metal detectors and magnetic detectors are also common in the prior art.

There is a need for a means of determining from a remote location whether or not a specific, important piece of mail has been delivered to a mailbox. Thus, a person at an office or place of work may want to know if an important contract, a check or a love letter has been delivered to the mailbox at home. Likewise, a person at home may want to know if a certain document has been delivered to the office mailbox on Saturday by the post office or at night by a courier service.

SUMMARY OF THE INVENTION

In the broadest aspect of the invention, an improved remote reporting system is provided which includes electrical means for detecting a selectively predetermined piece of mail introduced into a mailbox and sending a signal only when the presence of such piece of mail is so detected, and an electrical relay means of actuating, for example a telephone answering machine so that this information can be passed along to a telephone at a distant location.

In other aspects the electrical means may include a radio transmitter for installation with a mailbox and a detector for detecting the presence of the piece of mail, such detector being coupled to the transmitter for activating same. The electrical means may include a tuned radio receiver remote from the transmitter for receiving a broadcast radio signal from the transmitter, or direct wiring, without radio transmission, may be employed. The receiver is connected to the electrical relay means for activation thereof when the receiver receives the broadcast signal. The electrical relay means includes a normally open relay connected to the receiver, such relay being closed by a signal from the receiver. The electrical relay means includes a normally open relay connected to the receiver, such relay being closed by a signal from the receiver. The electrical relay means also includes a normally open latching relay coupled to the relay to close the latching relay upon closure of the relay. Quite often the relay is remotely located from the transmitter, and the electrical relay means is remotely located from a mailbox.

The magnetic material may be in the form of a simple adhesive or non adhesive tape or decal which can be placed inside or outside of the mail and which contains magnetic particles. Such material in this form is commonly used in retail store security systems and even in the U.S. Patent and Trademark Office public search room on the patent copies and in libraries on books. It may be desirable to use another type of magnetic material wherein the particles can be coded to identify the sender of the mail, for example, or other information which can then be passed along to a person receiving the announcement of receipt of such mail.

Additional aspects are seen wherein the detector may include a magnetic detector for detecting a piece of mail carrying a magnet and in another embodiment may include a metal detector for detecting a piece of mail carrying a metal object.

Accordingly, the principal object of the present invention is to provide a system for announcing the arrival of a specific piece of mail by simply including with the mail a small magnetic material or object or a metal object. It is understood that the sender of the mail had made a prior arrangement with the receiver of the mail to include such a magnetic or metal object with the designated mail. The magnetic or metal object actuates a magnetic or metal detector at a radio transmitter inside the mailbox, the detector causes the transmitter to broadcast a signal to a remote radio receiver which is operatively connected to an actuator for a telephone answerer or surveillance system having outside interrogation capability or the capability of sending out an announcement to the person receiving the mail.

Another object of the present invention is to provide an improved system which, because of its simplicity, can be readily understood and used by anyone and which can be easily installed.

Still another object of the present invention is to provide an additional, useful feature to a buidling automated control or surveillance system.

Yet another object of the present invention is to provide an improved system which, because of its simple construction, can be economically produced by conventional mass production methods and can be easily handled, packaged and distributed. One embodiment of this invention, described hereinafter, involves simple modifications to existing manufactured items.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DESCRIPTION OF THE PREFERRED EMBODIMENT

Figure 1:
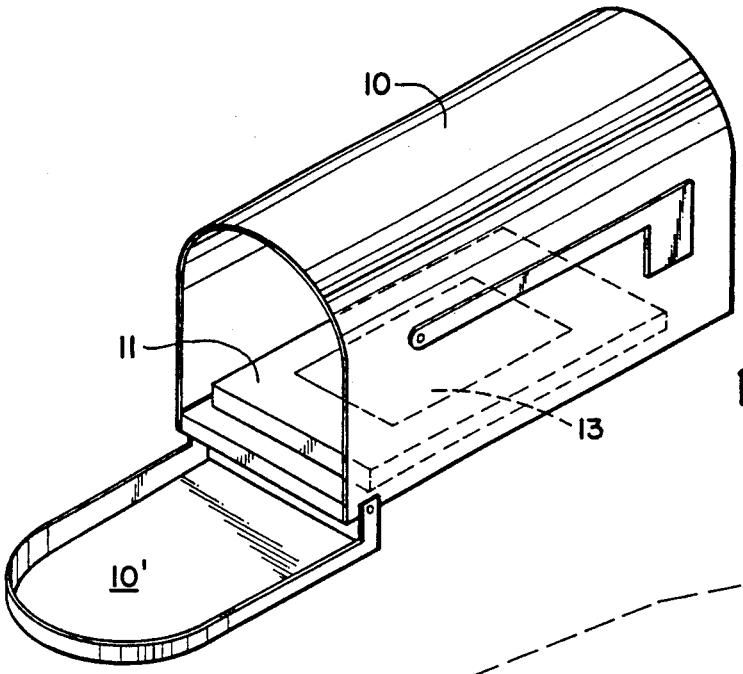
FIG. 1 is a pictorial view of the radio transmitter component of the remote control actuating system of the present invention installed inside a mailbox.
Figure 3:
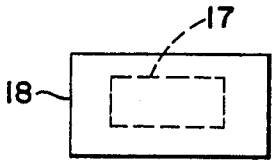
FIG. 3 is a top plan view of an envelope containing a magnet and used to activate the transmitter component of FIG. 1.

In accord with this invention, numeral 10 is a common roadside type mailbox with the door 10' shown open. Hidden lines of the mailbox are not shown. A radio transmitter component 11 may be a Postronic (TM) Mail Detector, which may be purchased through the Sporting Edge Catalog, 22121 Crystal Creek Boulevard, S. E., Bothell, Wash. 98021. In normal operation, when the postman opens the mailbox 10 and inserts mail, a photocell sensor activates a small, internal, 9-volt radio transmitter. The ensuing radio signal, with a range of about 750 feet, is detected by an AC powered radio receiver 12, a Postronic component located within a building 16, for example, which, in turn actuates a flashing light and an audible alarm. The dimensions of transmitter component 11 are 5⅝ inches wide by 18 inches long by ¾ inches high. The receiver 12 is in the form of a small box and is designed to properly be tuned to match transmitter 11.

According to the present invention, the photocell sensor within the Postronic Transmitter component 11 is removed and replaced by means for detecting a selectively predetermined piece of mail, such as a magnetic detection coil 13 or the like which is electrically coupled to transmitter 11 in substantially the same manner as the photocell sensor and serves to detect a magnetic field of a magnet which has been placed therein within an envelope by a mailman. Coil 13 can be affixed to the top surface of transmitter 11 with a thin plastic sheet or by any other suitable means. One or more reed switches (not shown) can be used instead of coil 13 to detect a magnetic field as is well known in the art.

Figure 2:
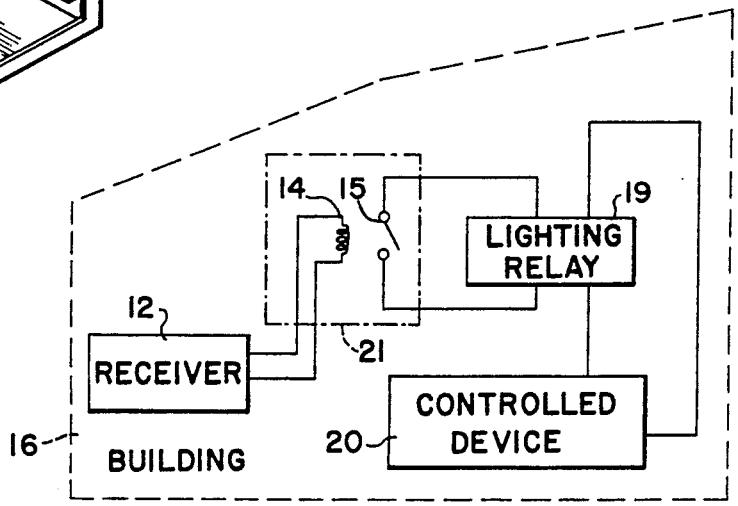
FIG. 2 is a circuit diagram of the radio receiver component of the present controlling the activation or deactivation of a signal device.

Coil 13 is properly sized, shaped and constructed so as to detect the presence of a small, high-intensity permanent magnet 17 delivered into mailbox 10 in an envelope 18 or affixed to a postcard. Upon detecting the presence of the magnet 17 by coil 13, the transmitter 11 sends a radio signal to receiver 12. As illustrated in FIG. 2, receiver 12 will then provide an output signal to apparatus for the utilization of the receiver 12 and its output signal in the operation and control of various devices and circuits. The means operated by the receiver 12 for controlling the ultimate operation of other devices is shown by the block 21 which includes a relay coil 14 and contacts or switch 15 operated to the closed position by the energization of the coil 14. The closing of switch 15 will energize latching relay 19 to, in turn provide electric power to the controlled device 20 which may be a relay, motor, motor starter, appliance or mechanical device as desired by the user.

Figure 4:
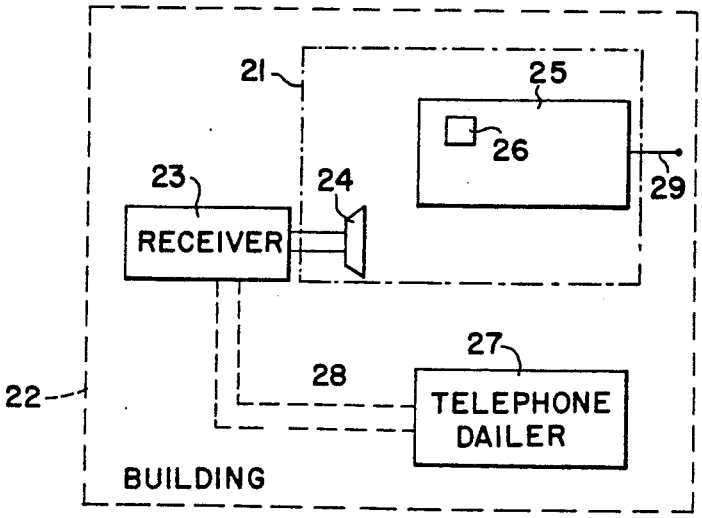
FIG. 4 is a circuit diagram of the radio receiver component of the present invention controlling the operation of telephone dialing equipment.

FIG. 4 illustrates the preferred embodiment of the invention wherein the means 21 operated by the receiver 23, which is preferably identical to receiver 12, is a source of audible sound comprising a speaker 24 and circuit means 25 and 26 that is responsive to the audible output from speaker 24. The device 25 is a programmable audio-responsive automatic telephone dialer such as a "House Sitter", a unit that is manufactured by the Heath Company and which, among other functions, includes a telephone dialer with an output at terminal or telephone jack 29 and includes microphone 26 which is responsive to audible sound levels in the immediate area of buidling 22. The device 25 is programmable to dial a preprogrammed telephone number in response to several different inputs including an appropriate sound level at the microphone 26. The level of sound needed to cause the telephone dialing function to be initiated is also set at device 25. Alternatively, telephone dialer 27, a conventional device well known in the art, could be hardwired, via lines 28, directly to receiver 23.

It is to be understood that other signaling devices such as telephone answering machines or other appropriate devices may be used in place of dialer 27 as may be desired and that, in a large building 22, the output of receiver 23 may be wired into the controls for so-called "Smart" buildings having extensive internal communication network capability.

Finally, it is worth noting that the flashing light and audible alarm of receiver 12 in the basic Postronic Detector can be used to notify an observer in what would be the simpliest embodiment of this invention.

In summary, a person mails a selectively predetermined piece of mail, such as an envelope 18 containing a magnetic device or decal 17 inside or outside on the envelope to the address at which the mailbox 10 is located. Alternately, a metal object 17 may be used in or on the envelope. The postman inserts the envelope 18 into a mailbox 10 and the envelope 18 is detected by a metal or magnetic material detector such as coil 13 which will activate transmitter 11 to send a radio signal to receiver 12 or 23. The receiver 12 or 23 then provides an output to an electrical device such as switches 15 or speakers 24 to initiate control of a device 20 or, via device 25, initiate communication with a telephone or answering machine which ultimately informs the user that mail has arrived and/or that a particular device or appliance has been turned on or off as the case may be.

The magnetic material 17 may be in the form of a plurality of strips or an array that are arranged in a pattern to form a code which is detectable by a magnetic detector such as coil 13 to activate the transmitter 11 when the code is detected.

Although the invention has been described as being based upon modifications to the Postronic Mail Detector, any type of similar equipment can be employed without departing from the scope of this invention. The assembly can be shaped to suit a vertical, wall-mounted mailbox, for example, and can be hard-wired rather than using a radio transmitter and receiver.

Other mail detectors on the commercial market similar to "Postronic" include "Mail-Call", "Mail Butler" and "Signamail". (The detector and transmitter for "Signamail" are affixed to the rear of the mailbox door.) These could be readily modified as in the case of "Postronic".

According to this invention, the dimensions and characteristics of all components should be properly selected to accommodate the dimensions of the selected mailbox, and the assembly should be tested and adjusted for proper functioning before an owner should rely on the operability of the installed system. Any bias due to the metal in the mailbox structure can be offset in the detection circuit in several different ways well known in the art.

The Heath "House Sitter" or a similar device could be employed to initiate a telephone call to a remote telephone to announce the arrival of the preselected mail at the intended mailbox.

As hereinabove set forth, the selectively predetermined piece of mail may contain a large ferrous metal surface or coupon which actuates a metal detector. Metal detectors are well known to the art and range in size from small, hand-held, battery-operated devices used by law enforcement officers at airports and the like to under-pavement automobile detectors to control traffic lights, for example. Referring to FIG. 1, coil 13 may be a detection coil selected to respond to a metal coupon, or the like, delivered in an envelope, or the like. Bias due to metal in the mailbox structure or small metal items, such as paper clips, can be offset or tuned out in the detection circuit in a manner well known to the art.

Envelopes integrally containing ferrous or magnetic material may likewise be used with the present system as well as mailing labels that include magnetic material integral therewith.

While the present invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A remote control actuating system comprising a mailbox, a radio transmitter attached to said mailbox, means for detecting the presence of a selectively predetermined piece of mail introduced into said mailbox and for actuating said transmitter, a tuned radio receiver remote from said transmitter, said transmitter broadcasting a radio signal to said tuned radio receiver, means operated by said receiver for controlling the ultimate operation of a relay, motor, motor starter, appliance or mechanical device located remote from said mailbox, said means for detecting including a metal detector and said piece of mail including a metal object.

2. The system of claim 1 wherein said metal detector includes a magnetic detector and said metal object is magnetic material.

3. The system of claim 1 wherein said means operated by said receiver is remotely located from said mailbox.

4. The system of claim 1 wherein said means operated by said receiver includes speaker means for generating audible sound and circuit means responsive to audible sound generated by said speaker means for providing a first output signal when audible sound generated by said speaker means exceeds a predetermined level as established by said circuit means.

5. The system as defined in claim 4 wherein said first output signal is a control signal for activating a telephone dialing device.

6. The system as defined in claim 4 wherein said circuit means includes a telephone dialing device.

7. The system as defined in claim 1 wherein said means operated by said receiver includes a speaker responsive to an output signal from said receiver for producing an audible sound output when said receiver provides said output signal and circuit means responsive to said audible sound output for dialing a predetermined telephone number when said audible sound output is provided by said speaker.

8. The system as defined in claim 1 wherein said means operated by said receiver includes a signalling means for signalling a user that the presence of a predetermined piece of mail introduced into said mailbox has been detected by said system.

9. The system as defined in claim 8 wherein said signalling means includes speaker means for generating audible sound.

10. The system as defined in claim 9 wherein said signalling means further includes switching means responsive to the generation of audible sound by said speaker means.

11. A remote control actuating system comprising a mailbox, a radio transmitter attached to said mailbox, means for detecting the presence of a selectively predetermined piece of mail introduced into said mailbox and for actuating said transmitter, a tuned radio receiver remote from said transmitter, said transmitter broadcasting a radio signal to said tuned radio receiver, means operated by said receiver for controlling the ultimate operation of a relay, motor, motor starter, appliance or mechanical device located remote from said mailbox, said means for detecting including a magnetic detector and said piece of mail including magnetic material.

12. The system of claim 11 wherein said means operated by said receiver is remotely located from said mailbox.

13. The system of claim 11 wherein said means operated by said receiver includes speaker means for generating audible sound and circuit means responsive to audible sound generated by said for providing a first output signal when audible sound generated by said speaker means exceeds a predetermined level as established by said circuit means.

14. The system as defined in claim 13 wherein said first output signal is a control signal for activating a telephone dialing device.

15. The system as defined in claim 13 wherein said circuit means includes a telephone dialing device.

16. The system as defined in claim 11 wherein said means operated by said receiver includes a speaker responsive to an output signal from said receiver for providing an audible sound output when said receiver provides said output signal and circuit means responsive to said audible sound output for dialing a predetermined telephone number when said audible sound output is provided by said speaker.

17. The system as defined in claim 11 wherein said means operated by said receiver includes a signalling means for signalling a user that the presence of a predetermined piece of mail introduced into said mailbox has been detected by said system.

18. The system as defined in claim 17 wherein said signalling means includes speaker means for generating audible sound.

19. The system as defined in claim 18 wherein said signalling means further includes switching means responsive to the generation of audible sound by said speaker means.

20. A remote control actuating system comprising a mailbox, a signal transmitter attached to said mailbox, means for detecting the presence of a selectively predetermined piece of mail introduced into said mailbox and for actuating said transmitter, a signal receiver remote from said transmitter and in electrical communication therewith, said transmitter sending a signal to said receiver when actuated, means operated by said receiver for controlling the ultimate operation of a relay, motor, motor starter, appliance or mechanical device located remote from said mailbox, said means for detecting including a metal detector and said piece of mail including a metal object.

* * * * *